US007699242B2

(12) United States Patent
Mochizuki et al.

(10) Patent No.: US 7,699,242 B2
(45) Date of Patent: Apr. 20, 2010

(54) INJECTOR

(75) Inventors: Kouichi Mochizuki, Anjo (JP); Masatoshi Kuroyanagi, Kariya (JP)

(73) Assignee: DENSO Corporation, Kariya (JP)

( * ) Notice: Subject to any disclaimer, the term of this patent is extended or adjusted under 35 U.S.C. 154(b) by 234 days.

(21) Appl. No.: 12/068,904

(22) Filed: Feb. 13, 2008

(65) Prior Publication Data

US 2008/0217441 A1 Sep. 11, 2008

(30) Foreign Application Priority Data

Mar. 5, 2007 (JP) ..... 2007-054070

(51) Int. Cl.
*B05B 1/08* (2006.01)

(52) U.S. Cl. ..... 239/102.2; 239/533.2; 239/584; 239/88

(58) Field of Classification Search ..... 239/88–92, 239/102.1, 102.2, 533.2, 533.8, 533.9, 533.12, 239/584, 585.1, 585.4, 96; 251/129.06
See application file for complete search history.

(56) References Cited

U.S. PATENT DOCUMENTS

| | | | | |
|---|---|---|---|---|
| 5,697,554 | A * | 12/1997 | Auwaerter et al. | 239/88 |
| 6,460,779 | B1 * | 10/2002 | Boecking | 239/102.2 |
| 7,100,895 | B2 | 9/2006 | Schurz et al. | |
| 7,455,244 | B2 * | 11/2008 | Boecking | 239/102.2 |
| 7,484,673 | B2 * | 2/2009 | Boecking | 239/88 |
| 2006/0283983 | A1 | 12/2006 | Boecking | |
| 2007/0023542 | A1 * | 2/2007 | Stoecklein | 239/88 |

FOREIGN PATENT DOCUMENTS

| | | |
|---|---|---|
| DE | 103 53 045 | 6/2005 |
| EP | 1 571 328 | 9/2005 |
| JP | A-5-215038 | 8/1993 |
| JP | A-10-148164 | 6/1998 |
| JP | A-2006-524298 | 10/2006 |
| JP | A-2007-500304 | 1/2007 |
| WO | 2005/026531 | 3/2005 |
| WO | 2005/075811 | 8/2005 |

OTHER PUBLICATIONS

Office action dated Oct. 14, 2009 issued in corresponding German Application No. 10 2008 000 301.8 with an at least partial English-language translation thereof.

* cited by examiner

*Primary Examiner*—Len Tran
*Assistant Examiner*—Jason J Boeckmann
(74) *Attorney, Agent, or Firm*—Nixon & Vanderhye P.C.

(57) ABSTRACT

An injector has a lift limiting member provided by a single plate member. The plate member has a stopper face, multiple hole sections, a flow passage hole, and a spring seat face. An axial end face of a needle head section of a needle contacts the stopper face when the needle lifts by a predetermined amount. Transmitting sections of a pressurizing piston are loosely inserted in the hole sections. High pressure fuel can pass through the flow passage hole. The spring seat face receives an end portion of a spring that biases the needle in a valve closing direction. The lift limiting member limits a valve opening lift position of the needle, so a stable injection quantity is obtained. Thus, a surface area of the single plate member can be used in multiple functions.

9 Claims, 3 Drawing Sheets

INJECTOR

CROSS REFERENCE TO RELATED APPLICATION

This application is based on and incorporates herein by reference Japanese Patent Application No. 2007-54070 filed on Mar. 5, 2007.

BACKGROUND OF THE INVENTION

1. Field of the Invention

The present invention relates to an injector that controls opening/closing action of a needle by increasing/decreasing control pressure of a pressure control chamber through movement of a pressurizing piston driven by a piezoelectric actuator.

2. Description of Related Art

An injector using an electromagnetic valve as an actuator is commonly used. In order to realize a large flow rate and high response, an injector using a piezoelectric actuator with a large generative force and high response is proposed.

For example, an injector described in Patent document 1 (International Publication No. 2005/075811) has a piezoelectric actuator 100 that makes a displacement when voltage is applied thereto, a pressurizing piston 110 driven by the piezoelectric actuator 100, an outer sleeve 120 for slidably holding an outer periphery of the pressurizing piston 110, a pressure control chamber 130, internal pressure (hydraulic pressure) of which increases/decreases according to movement of the pressurizing piston 110, a needle 160 that is slidably held inside a valve body 140 and that opens/closes an injection hole 150 and the like as shown in FIG. 5.

The pressure control chamber 130 is fluid-tightly defined by the pressurizing piston 110, the outer sleeve 120, the needle 160 and the valve body 140. If the voltage is applied to the piezoelectric actuator 100, the piezoelectric actuator 100 pushes the pressurizing piston 110 downward in the drawing. Accordingly, the volume of the pressure control chamber 130 decreases and the internal pressure rises.

The internal pressure of the pressure control chamber 130 acts on a pressure receiving face 161 formed in the needle 160 to function as a valve opening force for biasing the needle 160 in a valve opening direction (upward direction in the drawing). If the valve opening force exceeds a valve closing force (reaction force of a spring 170 and the like) biasing the needle 160 in a valve closing direction, the needle 160 lifts and opens the injection hole 150. Thus, the high pressure fuel supplied to an inside of the valve body 140 is injected into a combustion chamber 180 of the engine from the injection hole 150.

However, the above-mentioned injector does not have a stopper mechanism for limiting a valve opening lift position of the needle 160 and the lift amount of the needle 160 is decided by the displacement amount of the piezoelectric actuator 100. Accordingly, there has been a problem that the injection quantity is not stabilized due to the displacement variation of the piezoelectric actuator 100.

SUMMARY OF THE INVENTION

It is an object of the present invention to provide an injector capable of achieving a stable injection quantity by providing a stopper mechanism for limiting a valve opening lift position of a needle.

According to an aspect of the present invention, an injector has a piezoelectric actuator, a pressurizing piston, a cylindrical movable sleeve, a valve body, a needle, a pressure control chamber, and a lift limiting member. The piezoelectric actuator causes displacement when voltage is applied thereto. The pressurizing piston moves in an axial direction in accordance with the displacement of the piezoelectric actuator. The movable sleeve moves in the axial direction with the movement of the pressurizing piston. The valve body has an injection hole in an axial tip end portion thereof for injecting a high pressure fluid. The needle is slidably held in the valve body and opens/closes the injection hole. The pressure control chamber stores control pressure concerning the opening/closing action of the needle. The control pressure in the pressure control chamber is increased or decreased by the movement of the movable sleeve. The lift limiting member limits a valve opening lift position of the needle.

The control pressure of the pressure control chamber is increased or decreased to control the opening/closing action of the needle. The pressurizing piston has a head section that receives the displacement of the piezoelectric actuator and a transmitting section for transmitting the movement of the head section to the movable sleeve. The needle has a needle head section slidably fitted to an inner periphery of the movable sleeve. The lift limiting member is provided by a single plate member arranged between an axial end face of the needle head section and the head section of the pressurizing piston. The plate member is formed with a hole section, in which the transmitting section of the pressurizing piston is loosely inserted, and with a stopper face, with which the axial end face of the needle head section contacts when the needle lifts by a predetermined amount.

With such the structure, the valve opening lift position of the needle is limited as the axial end face of the needle head section contacts the stopper face of the lift limiting member during the valve opening lift of the needle for opening the injection hole. As a result, a stable injection quantity can be obtained irrespective of a displacement variation of the piezoelectric actuator.

The lift limiting member is provided by a single plate member formed with the hole section, through which the transmitting section of the pressurizing piston is loosely inserted. Accordingly, the plate member does not interfere with the motion of the pressurizing piston. Thus, the single plate member can be effectively arranged between the axial end face of the needle head section and the head section of the pressurizing piston. As a result, increase in the size of the injector, which can be caused if a lift limiting member is additionally provided, can be inhibited. The loose insertion means a state where the transmitting section of the pressurizing piston is inserted in the hole section of the plate member while forming a gap therebetween, i.e., a state where a special margin is provided therebetween.

According to another aspect of the present invention, in the above injector, the needle head section of the needle is formed in the shape of a cylinder, an inside of which defines a fluid passage through which the high pressure fluid flows. The head section of the pressurizing piston is formed with a plurality of the transmitting sections at equal intervals along a circumferential direction. The plate member is formed with a flow passage hole in a radial center thereof such that the high pressure fluid can pass through the flow passage hole and the flow passage hole communicates with the fluid passage. The stopper face is formed in a ring shape around the flow passage hole. A plurality of the hole sections are formed around the stopper face at equal intervals along the circumferential direction.

In such the structure, the needle head section is formed in the cylindrical shape and the fluid flow passage is formed in the cylindrical shape. Accordingly, the axial end face of the needle head section is formed in the shape of a ring. The stopper face provided in the plate member is formed in the ring shape, the flow passage hole is formed radially inside the stopper face, and the multiple hole sections are arranged around the stopper face at equal intervals along the circumferential direction. Thus, the surface area of the single plate member can be used in multiple functions.

According to another aspect of the present invention, the above injector has a spring that biases the needle in a valve closing direction with respect to the plate member. A surface of the stopper face is depressed into a stepped shape such that a bottom face of the stepped face defines a spring seat face for receiving an end portion of the spring.

In this case, the spring seat face can be effectively formed between the stopper face and the flow passage hole, so the surface area of the single plate member can be used in the more functions. The spring seat face is formed lower than the stopper face, that is, the spring seat face is depressed farther than the stopper face into a stepped shape. Accordingly, the end portion of the spring engaged with the spring seat face can be held certainly.

According to another aspect of the present invention, in the above injector, the valve body has a cylindrical wall section for holding an outer periphery of the movable sleeve. A certain face of a radial peripheral portion of the plate member on one side with respect to a thickness direction thereof is assembled to contact an axial end face of the cylindrical wall section. The certain face and the stopper face are formed as the same plane surface having no step.

In this case, since there is no step between the certain face and the stopper face, the certain face and the stopper face can be finished with high accuracy when the certain face and the stopper face are polished.

According to yet another aspect of the present invention, in the above injector, the plate member is formed such that thickness thereof is the same from the stopper face to the certain face.

In this case, since there is no step between the certain face and the stopper face, the certain face and the stopper face can be finished with high accuracy when the certain face and the stopper face are polished. Moreover, since the stopper face and the certain face can be formed in the same face, the valve opening lift position of the needle can be limited with high accuracy.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
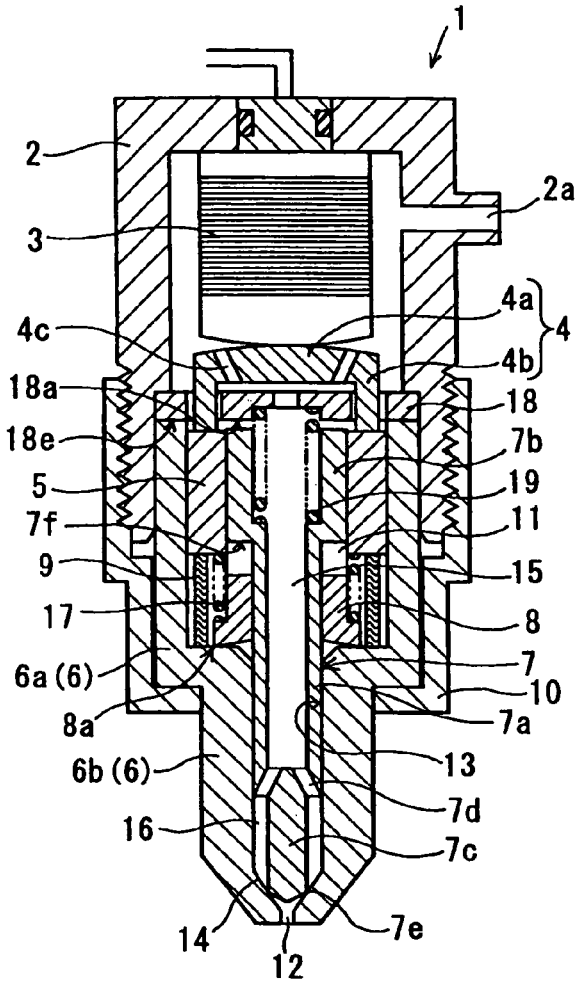
FIG. 1 is a sectional view showing an injector according to a first embodiment of the present invention.

Referring to FIG. 1, an injector 1 according to a first embodiment of the present invention is illustrated. The injector 1 of the present embodiment is a device that is attached to each cylinder of a diesel engine and that injects high pressure fuel, which is supplied from a common rail (not shown), directly into a combustion chamber in the cylinder, for example.

As shown in FIG. 1, the injector 1 includes a valve housing 2, a piezoelectric actuator 3, a pressurizing piston 4, a movable sleeve 5, a valve body 6, a needle 7, an inner sleeve 8, a lift limiting member and the like.

The valve housing 2 defines a sealed internal space between the valve housing 2 and the valve body 6 and is formed with a fuel inlet 2*a* connected to the common rail through a fuel pipe (not shown). The internal space is filled with the high pressure fuel flowing in from the fuel inlet 2*a*.

The piezoelectric actuator 3 is a common actuator having a capacitor structure of alternately laminated piezoelectric ceramic layers such as PZT (lead zirconate titanate) and electrode layers, for example. If voltage is applied, the piezoelectric actuator 3 elongates in the lamination direction. The piezoelectric actuator 3 is arranged inside the internal space of the valve housing 2. An end (upper end in FIG. 1) of the piezoelectric actuator 3 in the lamination direction is fixed to the valve housing 2.

The pressurizing piston 4 is arranged in contact with the other end side of the piezoelectric actuator 3 in the internal space of the valve housing 2 and moves in an axial direction (vertical direction in the drawing) in accordance with displacement of the piezoelectric actuator 3. The pressurizing piston 4 consists of a head section 4*a* that receives the displacement of the piezoelectric actuator 3 and transmitting sections 4*b* that transmit the motion of the head section 4*a* to the movable sleeve 5.

The head section 4*a* is formed with a communication passage 4*c* for connecting an inside and an outside of the pressurizing piston 4 such that the high pressure fuel can pass through the communication passage 4*c*.

Multiple transmitting sections 4*b* are provided at an outer peripheral portion of the head section 4*a* at equal intervals along a circumferential direction. Each transmitting section 4*b* extends from the head section 4*a* in an axial direction.

The movable sleeve 5 is slidably inserted in an inner periphery of a cylindrical wall section 6*a* provided in the valve body 6 and is pressed against the transmitting section 4*b* of the pressurizing piston 4 by a reaction force of an elastic body 9 located between the movable sleeve 5 and the valve body 6. Thus, the movable sleeve 5 can move in the axial direction together with the pressurizing piston 4. The pressurizing piston 4 receives the reaction force of the elastic body 9 through the movable sleeve 5, so the head section 4*a* is pressed against the other end side of the piezoelectric actuator 3.

The valve body 6 has the cylindrical wall section 6*a* inserted in an inner periphery of an opening of the valve housing 2 and a nozzle section 6*b* protruding into the combustion chamber of the diesel engine. The valve body 6 is fixed to the valve housing 2 with a retaining nut 10. A pressure control chamber 11 for controlling opening/closing action of the needle 7 is formed inside the valve body 6 with the use of a step provided between the cylindrical wall section 6*a* and the nozzle section 6*b*.

An injection hole 12 for injecting the fuel is formed in a tip of the nozzle section 6*b*. A guide hole 13 for holding the needle 7 is bored inside the nozzle section 6*b*. A seat face 14 in a conical shape is formed in a tip end portion of the guide hole 13.

The needle 7 has a middle shaft section 7*a* slidably held at the guide hole 13, a needle head section 7*b* provided on one end side (opposite from the injection hole side) of the middle shaft section 7*a*, and a small diameter shaft section 7*c* provided on the other end side of the middle shaft section 7*a*. The portion from the needle head section 7*b* to the middle shaft section 7*a* is formed to be hollow, and the inside of the hollow is used as a fuel passage 15.

The needle head section 7*b* has an external diameter larger than that of the middle shaft section 7*a* and is held slidably at an inner periphery of the movable sleeve 5.

The small diameter shaft section 7*c* has an external diameter smaller than that of the middle shaft section 7*a*. A fuel sump 16 is formed between an outer periphery of the small diameter shaft section 7*c* and an inner periphery of the guide hole 13. A communication hole 7*d* connecting the above-mentioned fuel passage 15 and the fuel sump 16 is formed in a stepped section between the middle shaft section 7*a* and the small diameter shaft section 7*c*. A seat section 7*e* is provided in a tip end portion of the small diameter shaft section 7*c* and is seated on the seat face 14 of the nozzle section 6*b* at the time of the valve-closing of the needle 7.

The pressure control chamber 11 is a sealed space defined by the valve body 6, the movable sleeve 5, the needle 7, and the inner sleeve 8. The pressure control chamber 11 is filled with the high pressure fuel. Internal pressure in the pressure control chamber 11 increases/decreases in accordance with the axial movement of the movable sleeve 5. The internal pressure acts on a step (referred to as a pressure receiving face 7*f*) provided between the middle shaft section 7*a* and the needle head section 7*b* of the needle 7 to work as a valve opening force for biasing the needle 7 in a valve opening direction (upward direction in the drawing).

The inner sleeve 8 is slidably fitted to the outer periphery of the middle shaft section 7*a* of the needle 7 protruding from the guide hole 13 in a direction opposite to the injection hole side (upward direction in the drawing). The inner sleeve 8 is biased by a spring 17 located between the inner sleeve 8 and the movable sleeve 5. Thus, an axial tip end portion (lower end portion in the drawing) of the inner sleeve 8 is pressed against a stepped face of the valve body 6. By arranging the inner sleeve 8 on the outer periphery of the middle shaft section 7*a*, the volume of the pressure control chamber 11 can be made compact. As a result, the valve opening force (hydraulic pressure acting on the needle pressure receiving face 7*f*) necessary for lifting the needle 7 can be acquired efficiently.

An edge section 8*a* is formed at the outermost periphery of a tip end portion of the inner sleeve 8, and the edge section 8*a* is pressed against the stepped face of the valve body 6.

Next, the lift limiting member according to the present embodiment will be explained. The lift limiting member consists of a single plate member 18 arranged between an axial end face (upper end face shown in FIG. 1) of the needle head section 7*b* and the head section 4*a* of the pressurizing piston 4. The plate member 18 is formed with a stopper face 18*a*, multiple hole sections 18*b*, a flow passage hole 18*c*, and a spring seat face 18*d* (refer to FIG. 2). The axial end face of the needle head section 7*b* contacts the stopper surface 18*a* when the needle 7 lifts by a predetermined amount. The transmitting sections 4*b* of the pressurizing piston 4 are loosely inserted in the hole sections 18*b*. The high pressure fuel can pass through the flow passage hole 18*c*. The spring seat face 18*d* receives an end of a spring 19 biasing the needle 7 in the valve closing direction.

Since the end face of the needle head section 7*b* is formed in a ring shape, the stopper face 18*a* is formed in the ring shape corresponding to the shape of the end face of the needle head section 7*b*.

Figure 2A:
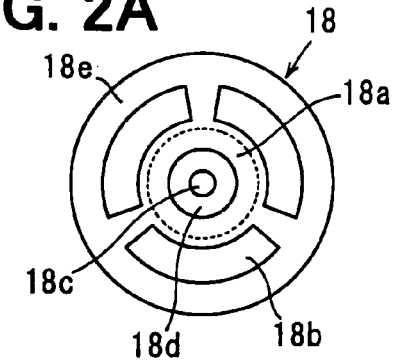
FIGS. 2A to 2D are plan views each showing a plate member according to the first embodiment.
Figure 2B:
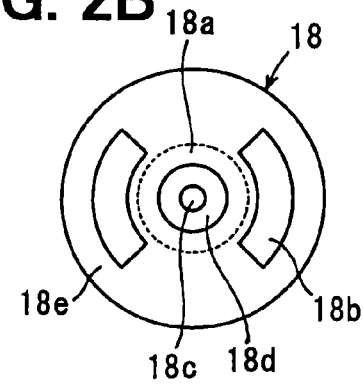
Figure 2C:
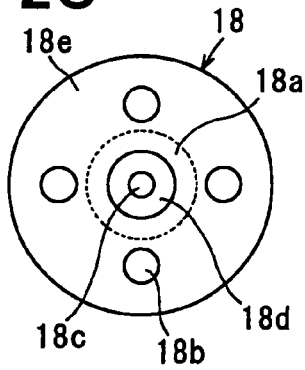
Figure 2D:
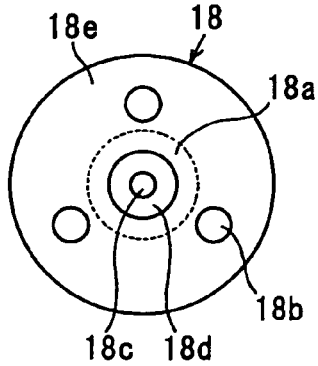

The multiple hole sections 18*b* are formed around the stopper face 18*a* at equal intervals along a circumferential direction. The hole section 18*b* is formed in the shape corresponding to the sectional shape of the transmitting section 4*b*. That is, if the sectional shape of the transmitting section 4*b* is an arc shape, the hole section 18*b* is formed also in the arc shape as shown in FIG. 2A or 2B. If the sectional shape of the transmitting section 4*b* is a round shape, the cross-section of the hole section 18*b* is formed also in the round shape as shown in FIG. 2C or 2D.

The flow passage hole 18*c* is formed in the radial center of the plate member 18. Since the flow passage hole 18*c* is formed in the plate member 18, the fuel passage 15 formed inside the needle 7 is not blocked by the plate member 18 and the high pressure fuel is supplied to the fuel passage 15 through the flow passage hole 18*c* even when the axial end face of the needle head section 7*b* is in contact with the stopper face 18*a*.

The spring seat face 18*d* is formed in the shape of a ring between the stopper face 18*a* and the flow passage hole 18*c*. The spring seat face 18*d* is formed lower than the stopper face 18*a* as shown in FIG. 1. That is, the spring seat face 18*d* is formed in the shape depressed farther than the stopper face 18*a*.

One end of the spring 19 is engaged with the spring seat face 18*d* of the plate member 18, and the other end of the spring 19 is engaged with a step provided to the inner periphery of the needle head section 7*b*. The spring 19 biases the needle 7 in the valve closing direction (downward direction in the drawing) with respect to the plate member 18.

A radial peripheral edge portion of the plate member 18 is held between the cylindrical wall section 6*a* of the valve body 6 and a step formed on the inner periphery of the valve housing 2 and is fixed by a tightening force of the retaining nut 10.

The plate member 18 is formed such that a face thereof contacting the axial end face of the cylindrical wall section 6*a* of the valve body 6, i.e., a face of the radial peripheral edge portion on one side with respect to a thickness direction thereof (referred to as a contact face 18*e*), and the stopper face 18*a* have the same height (same face) with no step. Moreover, the thickness of the plate member 18 is constant from the stopper face 18*a* to the contact face 18*e*.

Next, an operation of the injector 1 according to the present embodiment will be explained. When voltage is not applied to the piezoelectric actuator 3, i.e., when no displacement is caused in the piezoelectric actuator 3, the valve closing force applied to the needle 7 is greater than the valve opening force applied to the same. As a result, as shown in a part (a) of FIG. 3, the sheet section 7*e* of the needle 7 is seated on the seat face 14 of the nozzle section 6*b* to provide a valve closing state.

If the voltage is applied to the piezoelectric actuator 3, a displacement X occurs in the piezoelectric actuator 3 and the pressurizing piston 4 is pushed downward (in the drawing) due to the displacement X.

Figure 3:
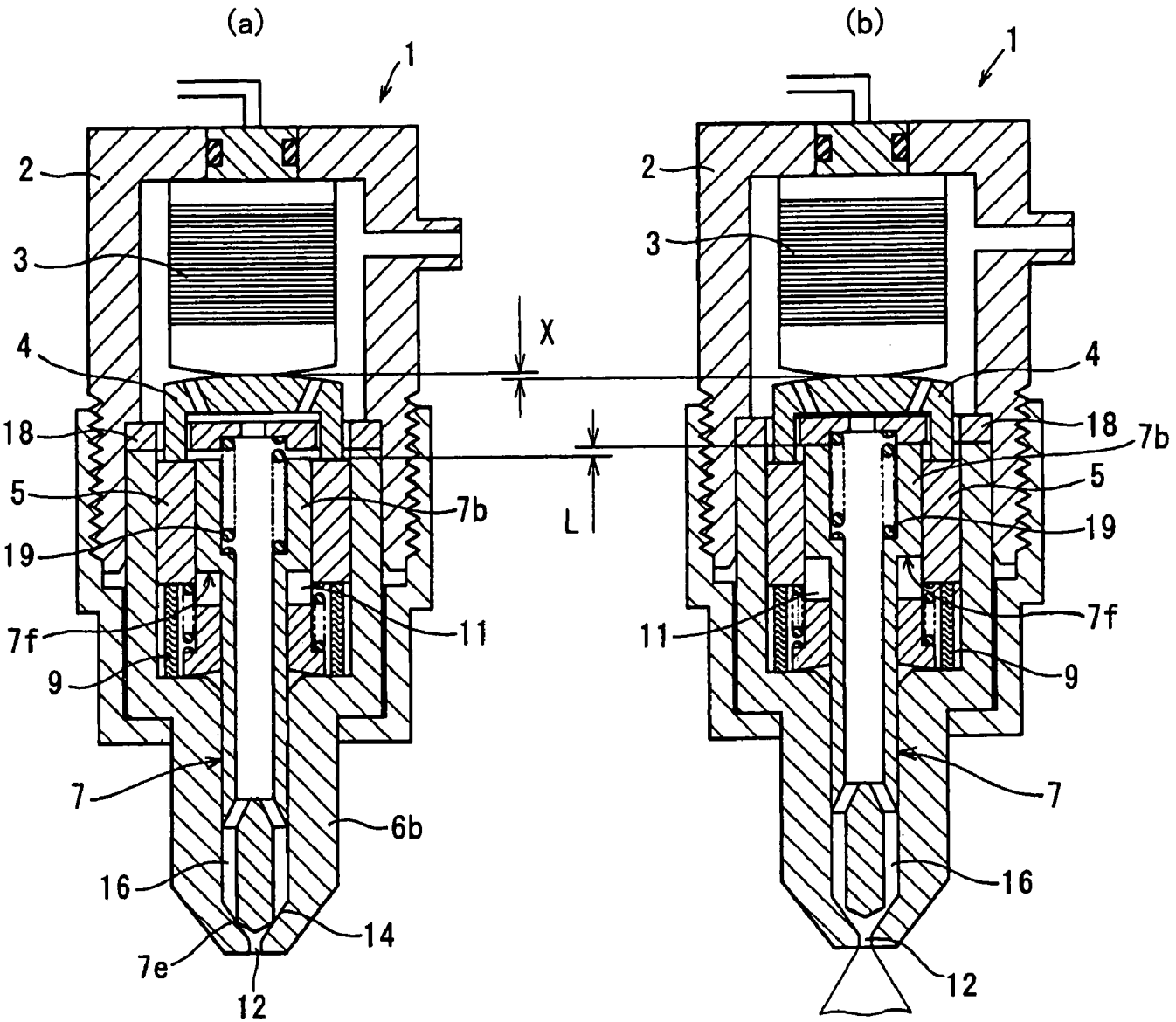
FIG. 3 is a sectional view showing the injector in a valve closing state or a valve opening state according to the first embodiment.

If the movable sleeve 5 moves downward in the drawing in response to the movement of the pressurizing piston 4, the volume of the pressure control chamber 11 decreases and the internal pressure increases. Thus, if the hydraulic pressure (control pressure) acting on the pressure receiving face 7*f* of the needle 7 exceeds the valve closing force of the spring 19, the needle 7 lifts to provide the communication between the fuel sump 16 and the injection hole 12. Accordingly, the high pressure fuel supplied through the fuel sump 16 is injected from the injection hole 12 to the combustion chamber of the diesel engine. At this time, a valve opening lift position of the needle 7 is limited as the axial end face of the needle head section 7*b* contacts the stopper face 18*a* of the plate member 18 as shown in a part (b) of FIG. 3B. In FIG. 3, L represents the lift amount of the needle 7.

Then, if the energization to the piezoelectric actuator 3 is stopped and the displacement is ceased (i.e., contraction occurs), the pressurizing piston 4 is pushed back together with the movable sleeve 5 by the reaction force of the elastic body 9. Thus, the volume of the pressure control chamber 11 enlarges and the internal pressure is decreased. Thus, if the hydraulic pressure acting on the pressure receiving face 7*f* of the needle 7 becomes smaller than the valve closing force of the spring 19, the needle 7 is depressed by the reaction force of the spring 19, so the seat section 7*e* of the needle 7 is seated on the seat face 14 of the nozzle section 6*b* and the communication between the fuel sump 16 and the injection hole 12 is broken. Thus, the injection ends.

In the injector 1 of the present embodiment, the valve opening lift position of the needle 7 is limited as the axial end face of the needle head section 7*b* contacts the stopper face 18*a* of the plate member 18 during the valve opening lift of the needle 7 for opening the injection hole 12. As a result, even if a variation occurs in the displacement of the piezoelectric actuator 3, a stable injection quantity can be obtained irrespective of the displacement variation.

Moreover, the plate member 18 not only has the stopper face 18*a*, but also has the hole sections 18*b*, through which the transmitting sections 4*b* of the pressurizing piston 4 are loosely inserted, the spring seat face 18*d* that receives the end portion of the spring 19, and the flow passage hole 18*c*, through which the high pressure fuel can pass, in an effectively arranged manner. Thus, the surface area of the single plate member 18 can be used in multiple functions. Thus, increase in the size of the injector 1, which can occur when a lift limiting member is additionally employed, can be inhibited.

Furthermore, the spring seat face 18*d* formed in the plate member 18 is formed lower than the stopper face 18*a*, and the step is formed between the stopper face 18*a* and the spring seat face 18*d*. Accordingly, the end portion of the spring 19 engaged with the spring seat face 18*d* can be held stably.

Moreover, the plate member 18 is formed such that the contact face 18*e* contacting the axial end face of the cylindrical wall section 6*a* of the valve body 6 and the stopper face 18*a* have the same height (same face) with no step. Therefore, the contact face 18*e* and the stopper face 18*a* can be finished with high accuracy when the contact face 18*e* and the stopper face 18*a* are polished.

Figure 4:
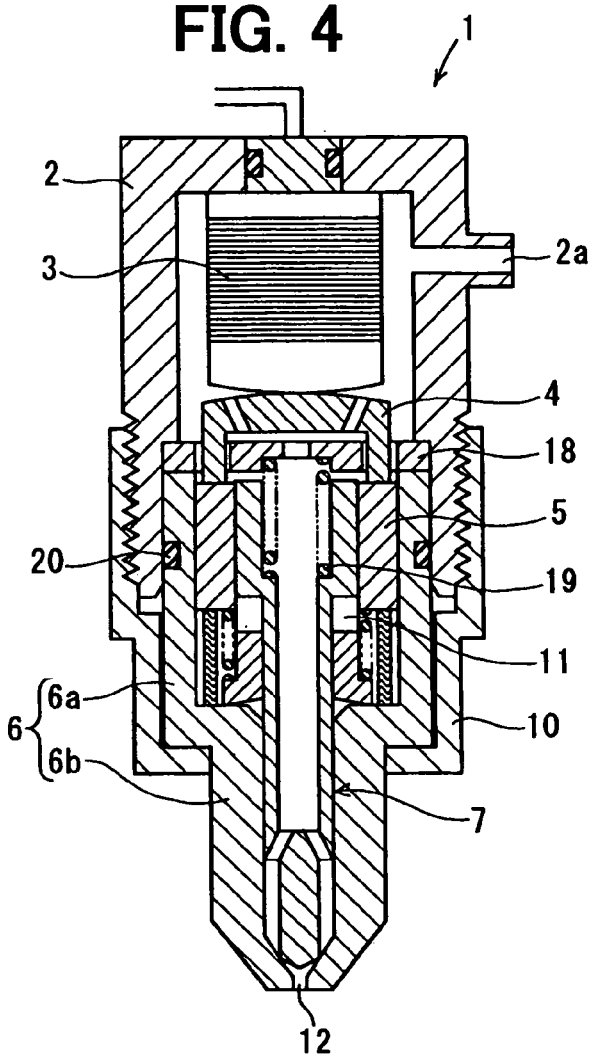
FIG. 4 is a sectional view showing an injector according to a second embodiment of the present invention.
Figure 5:
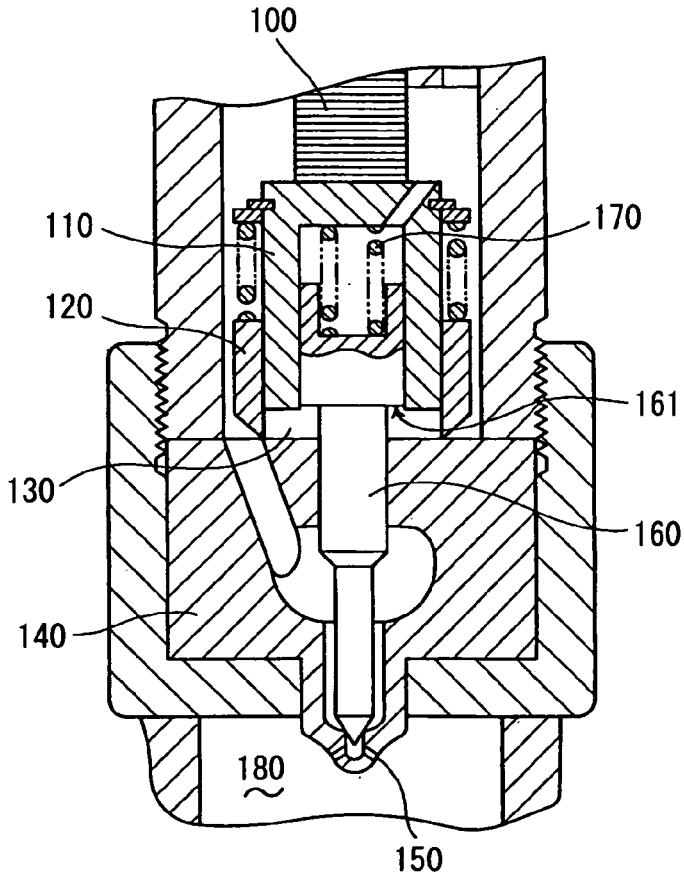
FIG. 5 RELATED ART
FIG. 5 is a sectional view showing an injector of a related art.

Next, an injector 1 according to a second embodiment of the present invention will be described. FIG. 4 is a sectional view showing the injector 1 according to the present embodiment. The injector 1 of the present embodiment is an example locating a sealing member 20 such as an O-ring in a fitting section between the valve housing 2 and the valve body 6 as shown in FIG. 4.

In the structure of the first embodiment, the peripheral edge portion of the plate member 18 is held between the step of the valve housing 2 and the axial end face of the cylindrical wall section 6*a* of the valve body 6. Thus, the fuel sealing is made by achieving close contact between the both metal surfaces. Therefore, the sealing performance has to be maintained by the tightening force (axial force) of the retaining nut 10.

As contrasted thereto, in the structure of the present embodiment, the fuel sealing is achieved by the sealing member 20. Accordingly, as compared with the structure of the first embodiment, the tightening force of the retaining nut 10 can be reduced. As a result, distortion of the respective parts due to the tightening of the retaining nut 10 can be eased, and the variation in the injection characteristic can be inhibited. Moreover, in the present embodiment, instead of the fixing method using the retaining nut 10, a fixing method using welding can be employed, for example.

In the injector 1 according to the first or second embodiment, the inner sleeve 8 is arranged around the middle shaft section 7*a*. Alternatively, the inner sleeve 8 may be eliminated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An injector comprising:

a piezoelectric actuator that causes displacement when voltage is applied thereto;

a pressurizing piston that moves in an axial direction in accordance with the displacement of the piezoelectric actuator;

a cylindrical movable sleeve that moves in the axial direction with the movement of the pressurizing piston;

a valve body that has an injection hole in an axial tip end portion thereof for injecting a high pressure fluid;

a needle that is slidably held in the valve body and that opens and closes the injection hole;

a pressure control chamber that stores control pressure concerning the opening/closing action of the needle and that is provided such that the control pressure in the pressure control chamber is increased or decreased by the movement of the movable sleeve; and a lift limiting member that limits a valve opening lift position of the needle, wherein the control pressure of the pressure control chamber is increased or decreased to control the opening/closing action of the needle, the pressurizing piston has a head section that receives the displacement of the piezoelectric actuator and a transmitting section for transmitting the movement of the head section to the movable sleeve, the needle has a needle head section slidably fitted to an inner periphery of the movable sleeve, the lift limiting member is provided by a single plate member arranged between an axial end face of the needle head section and the head section of the pressurizing piston, and the plate member is formed with a hole section, in which the transmitting section of the pressurizing piston is loosely inserted, and with a stopper face, with which the axial end face of the needle head section contacts when the needle lifts by a predetermined amount.

2. The injector as in claim 1, wherein the needle head section of the needle is formed in the shape of a cylinder, an inside of which defines a fluid passage through which the high pressure fluid flows, the head section of the pressurizing piston is formed with a plurality of the transmitting sections at equal intervals along a circumferential direction, the plate member is formed with a flow passage hole in a radial center thereof such that the high pressure fluid can pass through the flow passage hole and the flow passage hole communicates with the fluid passage, the stopper face is formed in a ring shape around the flow passage hole, and a plurality of the hole sections are formed around the stopper face at equal intervals along the circumferential direction.

3. The injector as in claim 2, further comprising:

a spring that biases the needle in a valve closing direction with respect to the plate member, wherein a surface of the stopper face is depressed into a stepped shape such that a bottom face of the stepped face defines a spring seat face for receiving a end portion of the spring.

4. The injector as in claim 1, wherein the valve body has a cylindrical wall section for holding a outer periphery of the movable sleeve, a certain face of a radial peripheral portion of to plate member on one side with respect to a thickness direction thereof is assembled to contact a axial end face of the cylindrical wall section, and the certain face and the stopper face are formed the same plane surface having no step.

5. The injector as in claim 4, wherein the plate member is formed such that thickness thereof is the same from the stopper face to the certain face.

6. The injector in claim 2, wherein the valve body has a cylindrical wall section for holding an outer periphery of the movable sleeve, a certain face of a radial peripheral portion of to plate member on one side with respect to a thickness direction thereof is assembled to contact an axial end face of the cylindrical wall section, and the certain face and the stopper face are formed as the same plane surface having no step.

7. The injector as in claim 6, wherein the plate member is formed such that thickness thereof is the same from the stopper face to the certain face.

8. The injector as in claim 3, wherein

The valve body has a cylindrical wall section for holding an outer periphery of the movable sleeve, a certain face of a radial peripheral portion of the plate member on one side with respect to a thickness direction thereof is assembled to contact an axial end face of the cylindrical wall section, and the certain face and the stopper face are formed as the same plane surface having no step.

9. The injector as in claim 8, wherein the plate member is formed such that thickness thereof is the same from the stopper face to the certain face.

* * * * *